US008112947B2

(12) United States Patent
Mead

(10) Patent No.: US 8,112,947 B2
(45) Date of Patent: Feb. 14, 2012

(54) PEDESTAL HEAD

(75) Inventor: Bruce Mead, Milton (CA)

(73) Assignee: Kingspan Holdings (IRL) Limited, Kingscourt, County Cavan (IE)

( * ) Notice: Subject to any disclaimer, the term of this patent is extended or adjusted under 35 U.S.C. 154(b) by 715 days.

(21) Appl. No.: 11/883,369

(22) PCT Filed: Feb. 8, 2006

(86) PCT No.: PCT/IE2006/000008

§ 371 (c)(1),
(2), (4) Date: Jul. 31, 2007

(87) PCT Pub. No.: WO2006/085294

PCT Pub. Date: Aug. 17, 2006

(65) Prior Publication Data

US 2008/0141601 A1 Jun. 19, 2008

Related U.S. Application Data

(60) Provisional application No. 60/650,515, filed on Feb. 8, 2005.

(51) Int. Cl.
*E04B 2/82* (2006.01)

(52) U.S. Cl. ..... 52/126.4; 52/126.5; 52/126.7; 52/262

(58) Field of Classification Search ..... 52/263, 52/126.1, 126.6, 126.7, 220.1, 262, 126.4, 52/126.5

See application file for complete search history.

(56) References Cited

U.S. PATENT DOCUMENTS

| | | | | | |
|---|---|---|---|---|---|
| 3,150,748 | A | * | 9/1964 | Liskey, Jr. | 52/396.04 |
| 3,180,460 | A | * | 4/1965 | Liskey, Jr. | 52/479 |
| 3,222,030 | A | * | 12/1965 | Thorpe | 254/100 |
| 3,616,584 | A | * | 11/1971 | Satori et al. | 52/126.6 |
| 4,085,557 | A | * | 4/1978 | Tharp | 52/263 |
| 4,279,109 | A | | 7/1981 | Madl, Jr. | |
| 4,438,610 | A | | 3/1984 | Fifer | |
| 4,835,924 | A | | 6/1989 | Blacklin et al. | |
| 4,922,670 | A | * | 5/1990 | Naka et al. | 52/126.6 |
| 4,996,804 | A | * | 3/1991 | Naka et al. | 52/126.6 |
| 5,048,242 | A | | 9/1991 | Cline | |
| 5,412,914 | A | * | 5/1995 | Daw et al. | 52/126.6 |
| 5,477,649 | A | * | 12/1995 | Bessert | 52/263 |
| 5,546,717 | A | | 8/1996 | Penczak et al. | |
| 5,675,950 | A | | 10/1997 | Schilham | |
| 6,332,292 | B1 | | 12/2001 | Buzon | |
| 6,918,217 | B2 | * | 7/2005 | Jakob-Bamberg et al. | 52/263 |
| 2003/0089049 | A1 | | 5/2003 | Scissom et al. | |
| 2003/0177723 | A1 | | 9/2003 | Jakob-Bamberg | |

FOREIGN PATENT DOCUMENTS

| | | |
|---|---|---|
| EP | 0325051 | 7/1989 |
| FR | 2567945 | 1/1986 |
| FR | 2835553 | 8/2003 |
| JP | 63-194063 | 8/1988 |

* cited by examiner

*Primary Examiner* — Eileen D Lillis
*Assistant Examiner* — Chi Nguyen
(74) *Attorney, Agent, or Firm* — Jacobson Holman PLLC

(57) ABSTRACT

A pedestal head for a floor panel comprises includes a base for a lower part of a floor panel and an upper support for receiving an upper part of a floor panel. The pedestal head has a receiver or projection for receiving and locating a corresponding projection or receiver of the floor panel The pedestal head may be die formed from a single piece of metal.

12 Claims, 9 Drawing Sheets

PEDESTAL HEAD

This is a national stage of PCT/IE06/000008 filed Feb. 8, 2006 and published in English, claiming benefit of US provisional application No. 60/650,515, filed Feb. 8, 2005.

FIELD OF THE INVENTION

This invention relates to pedestal heads for locating and fastening a raised floor panel thereto, and includes methods of locating and fastening an access floor panel to a pedestal.

BACKGROUND OF THE INVENTION

Raised access floor panels are widely used. Generally speaking, such access floor panels are located and attached to a flat plate presented at the upper end of a pedestal as generally illustrated in the prior art drawing of FIG. 1. The panel in the prior art drawing generally utilizes a flat head bolt which is disposed through a hole in the panel so as to be coaxially aligned with the threaded hole in the pedestal plate.

Such prior art system has a number of drawbacks including:

1. the lining up of the hole in the panel with the hole in the pedestal must be done by eye by trial and error since the panel covers up the threaded hole in the pedestal, thus malting lining up difficult, and assembly time consuming and difficult.
2. the fasteners must be disposed in the holes in order to have lateral stability, therefore the panels cannot be installed without the fasteners.
3. the load on the panel is cantilevered out past the centre axis support of the pedestal which causes a teeter-totter effect when loaded.

This causes movement in the system from panel to panel as loads are moved over the system.

Other prior art arrangements are known and include the resilient pedestal head for a raised access floor system disclosed in US Publication No. 2003/0089049A1, and a device for adjusting inclination when building on blocks is shown in U.S. Pat. No. 6,332,292B1. Furthermore U.S. Pat. No. 5,675,950 relates to a raised flooring system and methods of forming components which utilize thin sheet metal, typically galvanized steel. U.S. Pat. No. 5,546,717 relates to access floor trench raceways. U.S. Pat. No. 5,048,242 illustrates an access floor system which includes a plurality of floor panels, each panel having a pan and a cooperating top plate. Furthermore U.S. Pat. No. 4,835,924 illustrates a self-gridding flooring system. U.S. Pat. No. 4,438,610 relates to a clamped access floor panel assembly for mounting an access floor a spaced distance above a base floor. A plurality of panels are supported by an array of pedestals to form a floor surface. The panels are clamped to the pedestals at their corners and optionally at their side by clamping devices accessible through small access holes. U.S. Pat. No. 4,279,109 relates to an access floor mounting assembly. Another raised access floor system is illustrated in United States Publication No. 2003/0177723A1.

It is an object of this invention to provide an improved access floor panel system. It is also an object of this invention to provide a quick clamp access floor system.

STATEMENTS OF INVENTION

According to the invention there is provided a pedestal head for a floor panel comprising a base for a lower part of a floor panel, and an upper support for receiving an upper part of a floor panel, the pedestal head having a receiver or projection for receiving and locating a corresponding projection or receiver of the floor panel.

In one embodiment the pedestal head comprises a projection for receiving and locating a corresponding receiver of the floor panel.

The pedestal head projection may extend from the base of the head. The pedestal head projection may comprise a tab which extends to engage in a corresponding receiver in a lower part of the floor panel.

In one embodiment the upper part of the floor panel comprises a flange which is supported by the upper support of the pedestal head.

In one case the head receiver or head projection is located at a peripheral edge or corner of the base.

In one embodiment the pedestal head is formed from a single piece of metal. The head may be stretch formed. Preferably the head is die formed.

In one embodiment the length of the head between the base and the upper support is slightly greater than the depth of said panel. The difference between the length of the head and the depth of the panel is preferably less than about 50 thousands of an inch.

In one embodiment said panel comprises a peripheral flange which is supported by the upper surface of the head, the flange extending to substantially a central longitudinal axis of the head.

In one case said base includes a threaded hole, and said panel includes a hole alignable with said threaded hole for coaxially receiving a fastener.

In another embodiment said projection comprises a tab depending from a peripheral corner of said panel.

In a further embodiment said projection comprises a cone depending from a peripheral corner of said panel.

In one case said base supports a bottom of said panel. Said upper surface may support a peripheral flange of said panel.

In one embodiment said pedestal head is disposed at an upper end of a pedestal resting on a surface. Said pedestal head may include means for adjusting the height of said pedestal head relative to said surface.

The invention also provides a method of locating and fastening an access floor panel to a pedestal, the access floor panel having a bottom and a top with a peripheral flange extending therefrom, the panel having a hole therethrough adjacent to a corner thereof, and the pedestal comprising a pedestal head having a base with a threaded hole extending therethrough and an upper support, the method including disposing a corner of said panel over the pedestal head so that the flange is resting on the upper support of the pedestal head and the bottom of the panel is spaced slightly above the base of the pedestal head;

inserting a fastener through the said panel hole and said pedestal threaded hole; and tightening the fastener so that the base of the pedestal head comes into contact with the bottom of the panel.

In one embodiment the panel has a receiver formed in the base thereof for engagement with a projection on the base of the pedestal head and the method comprises locating the panel relative to the pedestal head so that the receiver is aligned with the projection.

The invention further provides a pedestal head for a floor panel having at least one projection depending from said panel including a base, and an upper surface extending from said base, said upper surface including at least one aperture for receiving and locating said projection.

In yet another aspect the invention provides a pedestal head for a floor panel comprising a base for a lower part of a floor panel and an upper support for receiving an upper part of a floor panel, the pedestal head being die formed from a single piece of metal.

The invention also provides a pedestal head locator for a floor panel having a projection depending from a flange extending peripherally outwardly from a corner of said panel, and a lower panel surface including a base, intersecting U-shaped supports extending upwardly from said base so as to define an upper surface having four apertures, each aperture adapted to locate said projection of said panel, and a bolt extending through a hole disposed adjacent a corner of said panel for coaxial reception by a threaded hole disposed in said base for clamping said panel thereof. The invention, in a further aspect, provides a method of locating and fastening an access floor panel to a pedestal including disposing a corner of said panel having a hole therethrough and a peripheral flange with a depending projection over a pedestal head having a base and a threaded hole and an upper surface extending from said base with an aperture for receiving and locating said projection, and disposing a corner of said panel having a hole therethrough and a peripheral flange with a depending projection over a pedestal head having a base and a threaded hole and an upper surface extending from said base with an aperture for receiving and locating said projection inserting a fastener through said panel hole and said pedestal head threaded a hole for fastening thereto.

It is an aspect of this invention to provide a pedestal head for a floor panel having at least one projection depending from said panel including a base; an upper surface extending from said base, said upper surface including at least one aperture for receiving and locating said projection.

It is another aspect of this invention to provide a pedestal head locator for a floor panel having a projection depending from a flange extending peripherally outwardly from a corner of said panel and a lower panel surface, including a base; intersecting U-shaped supports extending upwardly from said base so as to define an upper surface having four apertures, each aperture adapted to locate said projection of said panel; a bolt extending through a hole disposed adjacent a corner of said panel for coaxial reception by a threaded hole disposed in said base for clamping said panel thereto.

It is another aspect of this invention to provide a method of locating and fastening an access floor panel to a pedestal including disposing a corner of said panel having a hole thereto and a peripheral flange with a projection depending therefrom, over a pedestal head having a base with a threaded hole and an upper surface extending from said base with an aperture for receiving and locating said projection; inserting a fastener through said hole and through the threaded hole for fastening thereto.

BRIEF DESCRIPTION OF DRAWINGS

The invention will be more clearly understood from the following description thereof given by way of example only, in which:—

DETAILED DESCRIPTION OF THE INVENTION

Figure 1:
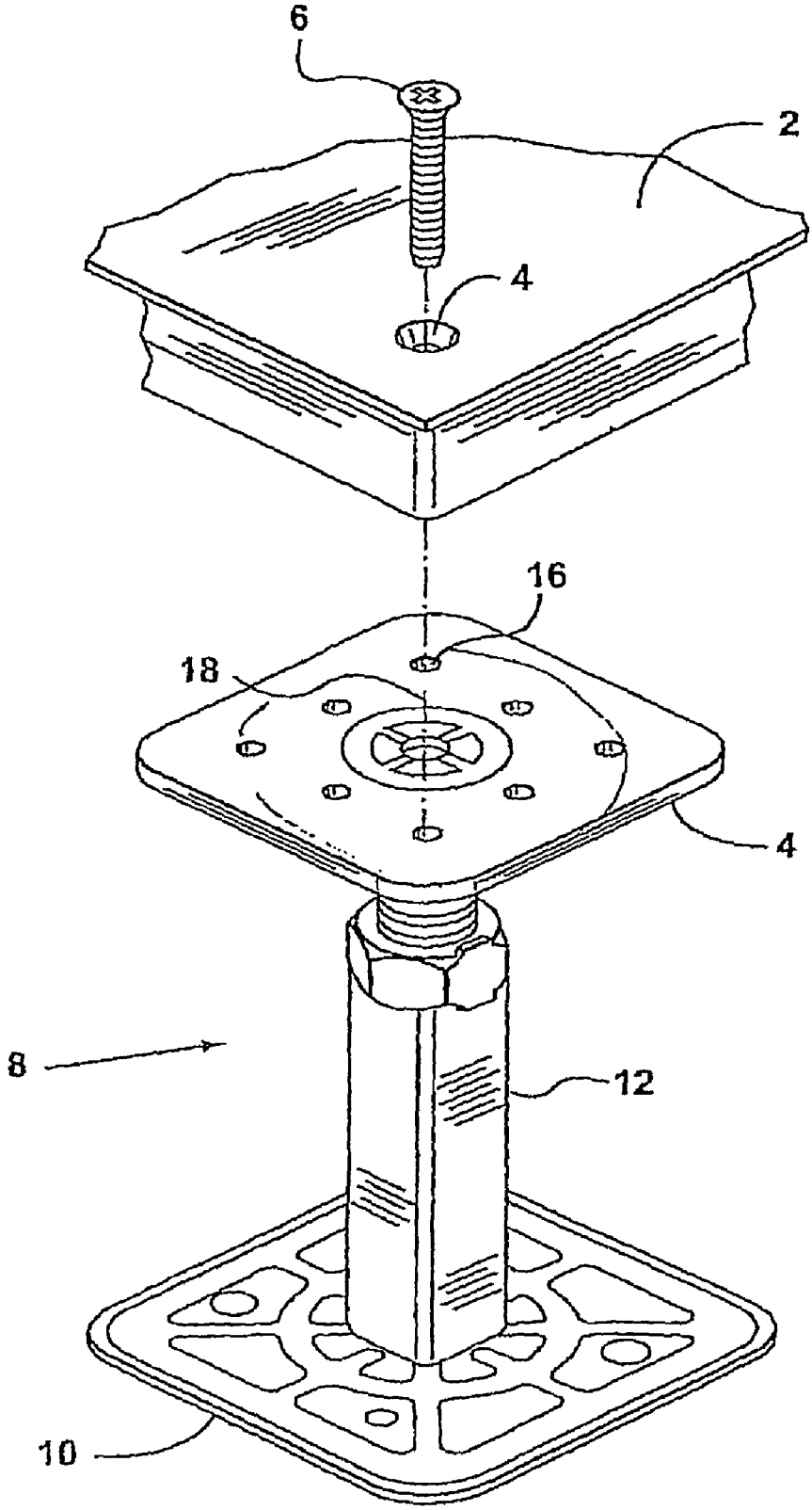
FIG. 1 (Prior Art)
FIG. 1 is a perspective, partially exploded view of a prior art access floor panel system.

In the description that follows, like parts are marked in some cases with the same respective reference numerals. The drawings are not necessarily to scale and in some instances proportions may have been exaggerated in order to more clearly depict certain features of the invention.

FIG. 1 illustrates an example of a prior art pedestal assembly for an access floor system. Generally speaking prior devices include a floor panel 2 having a hole 4 disposed in one corner of the panel tube for receiving a fastener 6. The panel 2 is adapted to rest on top of a flat plate 4 of a pedestal 8 which has a lower end 10 adapted to rest on a surface or sub-floor. The pedestal 8 generally includes an adjustable means which as shown comprises a nut and threaded shaft. Pedestal head base 4 includes a plurality of threaded holes 16 which must coaxially align with the hole 4 and fastener 6. As previously described the drawbacks of the prior art device include:

1. the difficulty in lining up the hole 4 with the threaded hole 16.
2. the fastener 6 must be in the hole 4 and the threaded hole 16 in order to have lateral stability and therefore the panels cannot be installed without fasteners.
3. the load of the panel 2 is cantilevered generally outwardly particularly when using stringers from the centre axis 18 which causes a teeter-totter effect when loaded.

Figure 2:
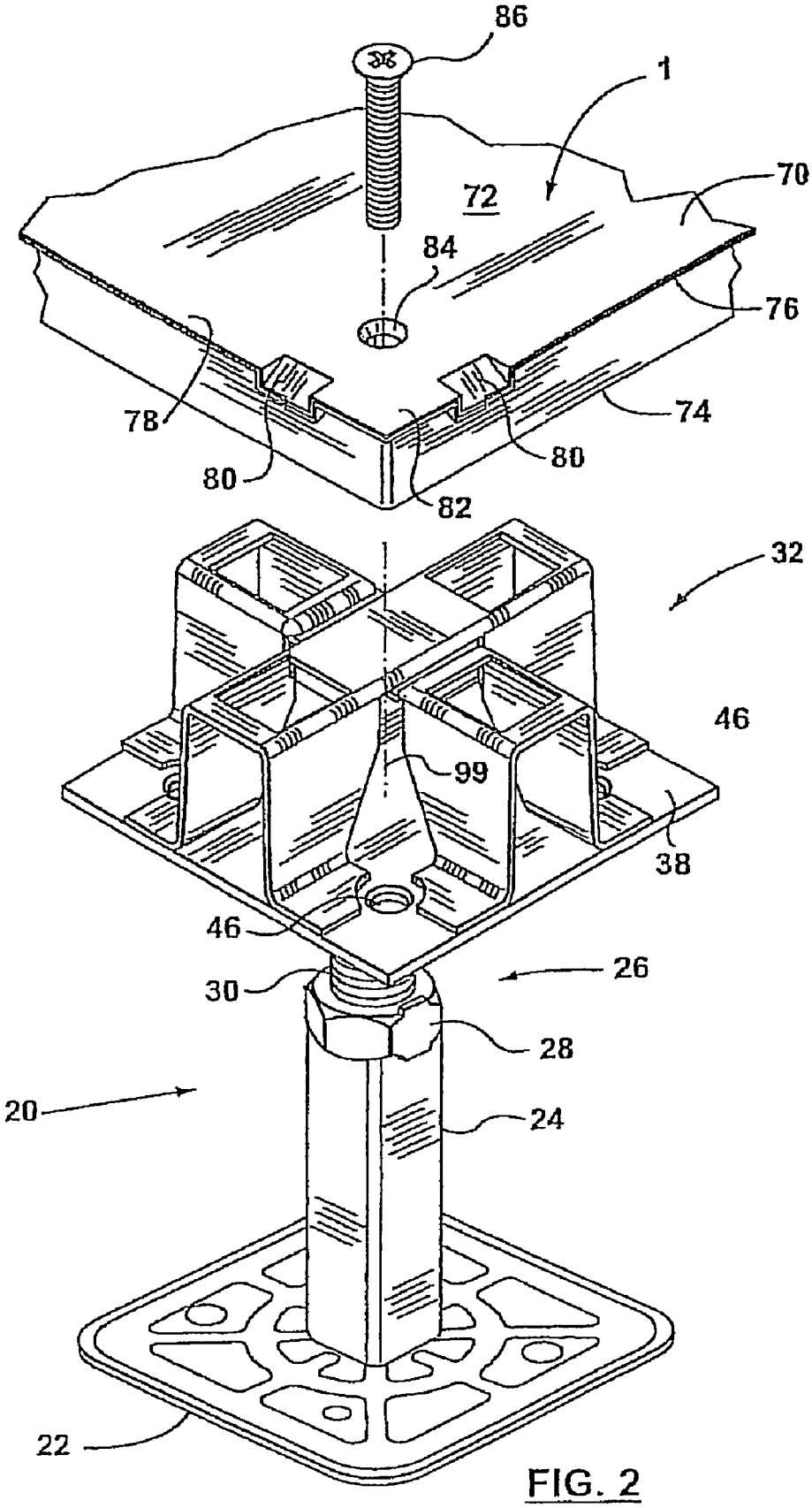
FIG. 2 is an exploded perspective view of a floor panel system of the invention.

FIG. 2 generally describes an aspect of the invention which includes a pedestal 20 having a lower end 22 resting on a surface or subfloor, a pedestal shaft 24 carrying pedestal height adjusting means 26 which as shown comprise a rotatable nut 28 for rotational threaded movement around a threaded shaft 30 so as to adjust the height of the pedestal relative to the lower surface 22 in a manner well known to those persons skilled in the art.

In the embodiment shown in FIG. 2 the base 4 of the prior art device has been replaced with a pedestal head locator generally illustrated as 32 in FIG. 2. The pedestal head locator is attached to the threaded shaft 30 in any number of ways including welding.

Figure 3:
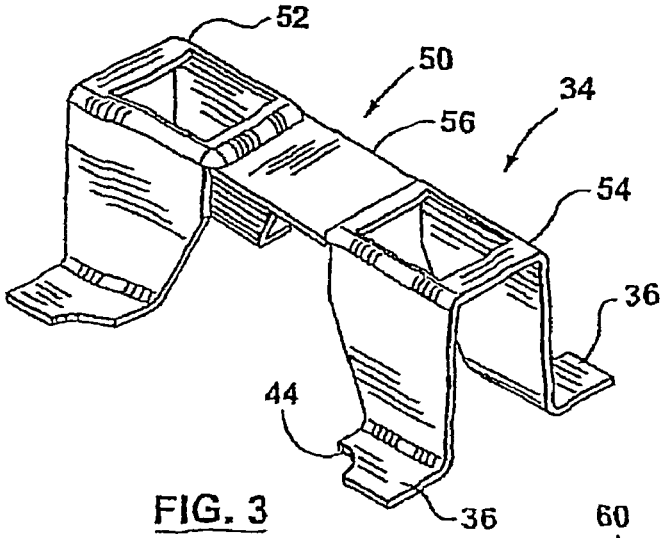
FIG. 3 is a perspective view of a component of a pedestal head assembly of FIG. 2.
Figure 4:
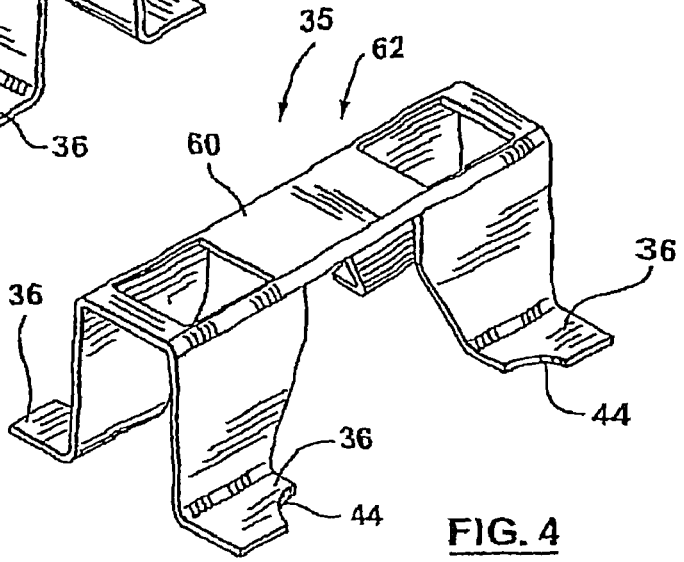
FIG. 4 is a perspective view of another component of the pedestal head assembly of FIG. 2.
Figure 5:
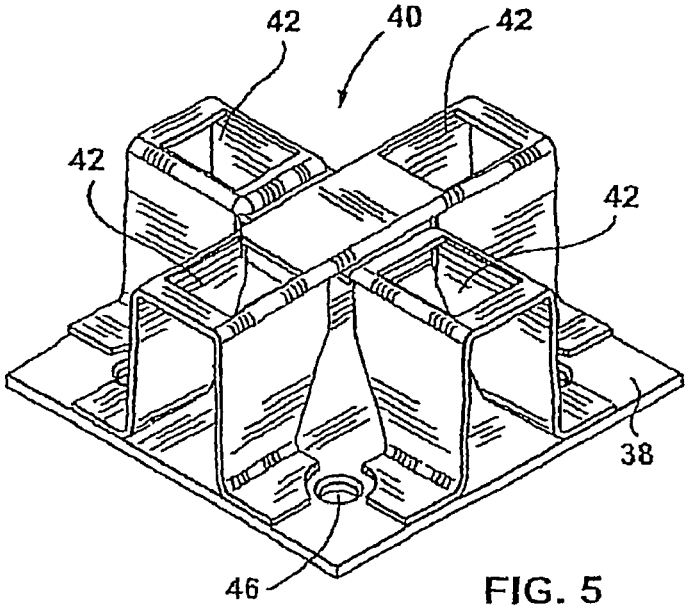
FIG. 5 is a perspective view of the pedestal head assembly of FIG. 2.
Figure 6:
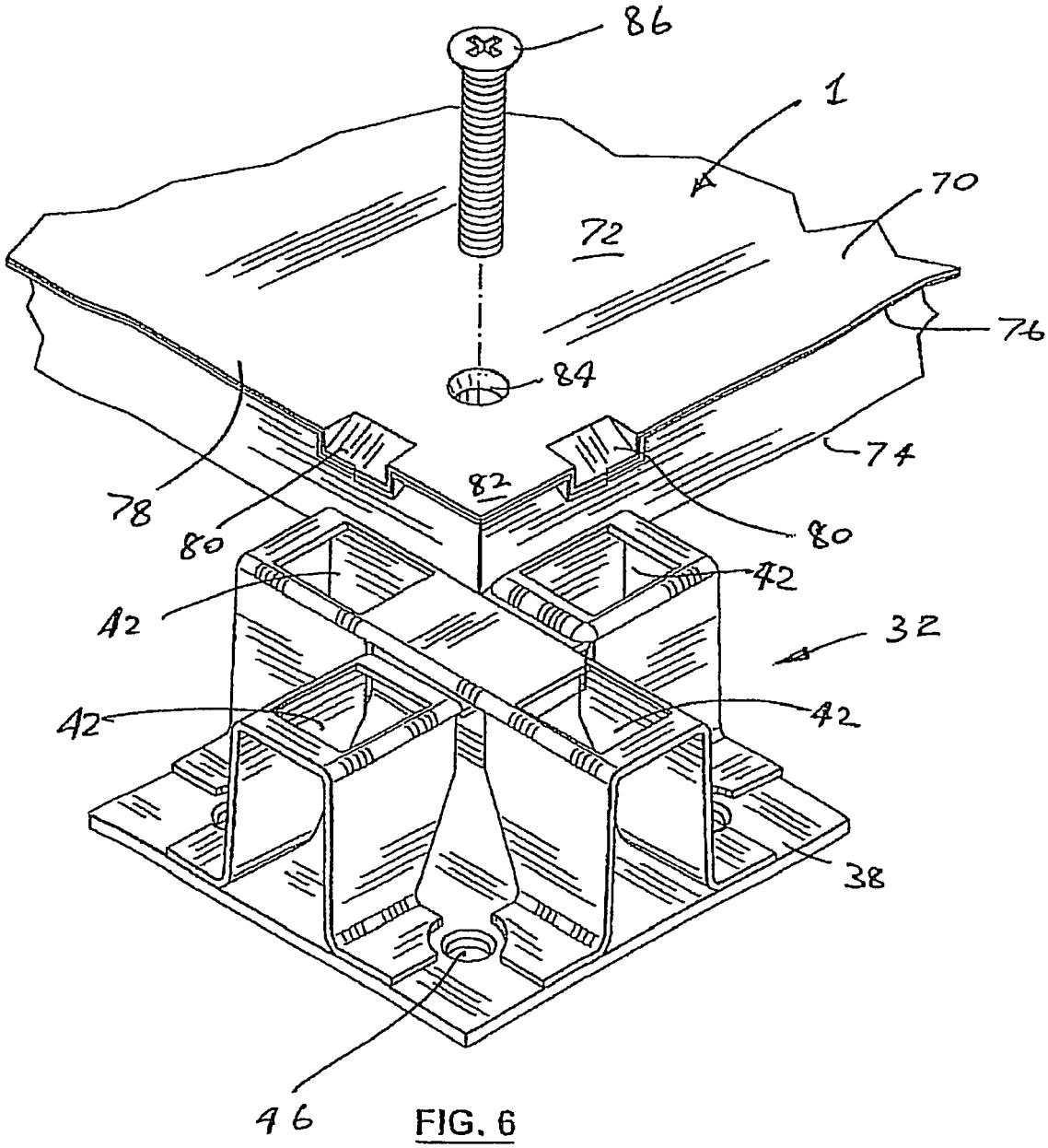
FIG. 6 is a perspective, partially exploded view of the pedestal head and an associated panel.

The pedestal head locator 32 is comprised in one embodiment of generally U-shaped cross-sectional members or supports 34 and 35 shown in FIGS. 3 and 4. Generally speaking the U-shaped cross-sectional members 34 and 35 generally comprises spaced apart lower legs 36 adapted to rest on the base 38 as shown in FIG. 5. The lower base legs 36 extend generally upwardly from said base 38 so as to present an upper surface 40 having at least one aperture 42. In the embodiment shown in FIG. 5 four apertures 42 are shown. More specifically FIG. 5 illustrates intersecting supports 34 and 35 so as to define the upper support surface 40. The legs 36 are fastened to the base 38 by any number of means including spot welding, riveting, or utilizing appropriate adhesives. The legs 36 have curved or arched cutaways 44 so as to clear the threaded holes 46 disposed in the base 38 as shown. The threaded holes preferably are countersunk so as to easily locate the fastener 6.

The upper surface 50 of U-shaped number 34 presents two lands 52 and 54 which present the apertures 42. The upper surface 50 also includes a recessed upper surface 56 which is disposed slightly below the lands 52 and 54 and is sized so as to receive intermediate portion 60 of U-shaped number 35 as illustrated in FIG. 5. The upper surface 62 of U-shaped number 35 presents the intermediate portion 60 as well as two spaced apertures 42.

The thickness of intermediate portion 60 is accommodated by the recessed portion 56 so that the assembled pedestal head locator 32 as shown in FIG. 5 presents an upper surface which is substantially in the same plane.

The panel 70 includes an upper panel surface 72 and a lower panel surface 74. The peripheral edge 76 of the panel 70 extends outwardly around the panel so as to define a flange 78 so as to present at least one depending projection 80 adapted to be received by at least one aperture 42.

In the embodiment shown in FIG. 2 two projections 80 in the form of tabs are disclosed.

The corner 82 of the panel 70 includes a hole 84 adapted to receive a fastener 86. The hole 84 passes through the upper surface 72 of the panel through to the lower surface 74 of the panel and is adapted to be coaxially aligned with the threaded holes 46.

More specifically the lower surface of the flange 78 of a corner of the panel 82 is adapted to rest along one quadrant of the upper surface 40 as shown.

The projections or tabs 80 are received within the apertures 42 so as to quickly locate the corner. The pedestal head locator 32 is capable of supporting the panel 70 without fasteners since the tabs are located and locked within the apertures 42 so as to minimize the possibility of sliding off. Thereafter since the tabs 82 are smaller than the apertures 42 the panel 70 may be easily shifted or moved so as to properly align the hole 84 with the corresponding coaxial threaded hole 46. The tabs 80 in the apertures 42 prevent the panel 70 from sliding off the pedestal head. Thereafter the fastener 86 may be disposed into the hole 84 and threaded into threaded hole 46 in a simple and quick manner. All four corners of four adjacent panels 70 may be assembled in like fashion.

Furthermore the pedestal 20 may be adjusted in height by utilizing the height adjustment means 26 in the manner well known to those persons skilled in the art.

Figure 7:
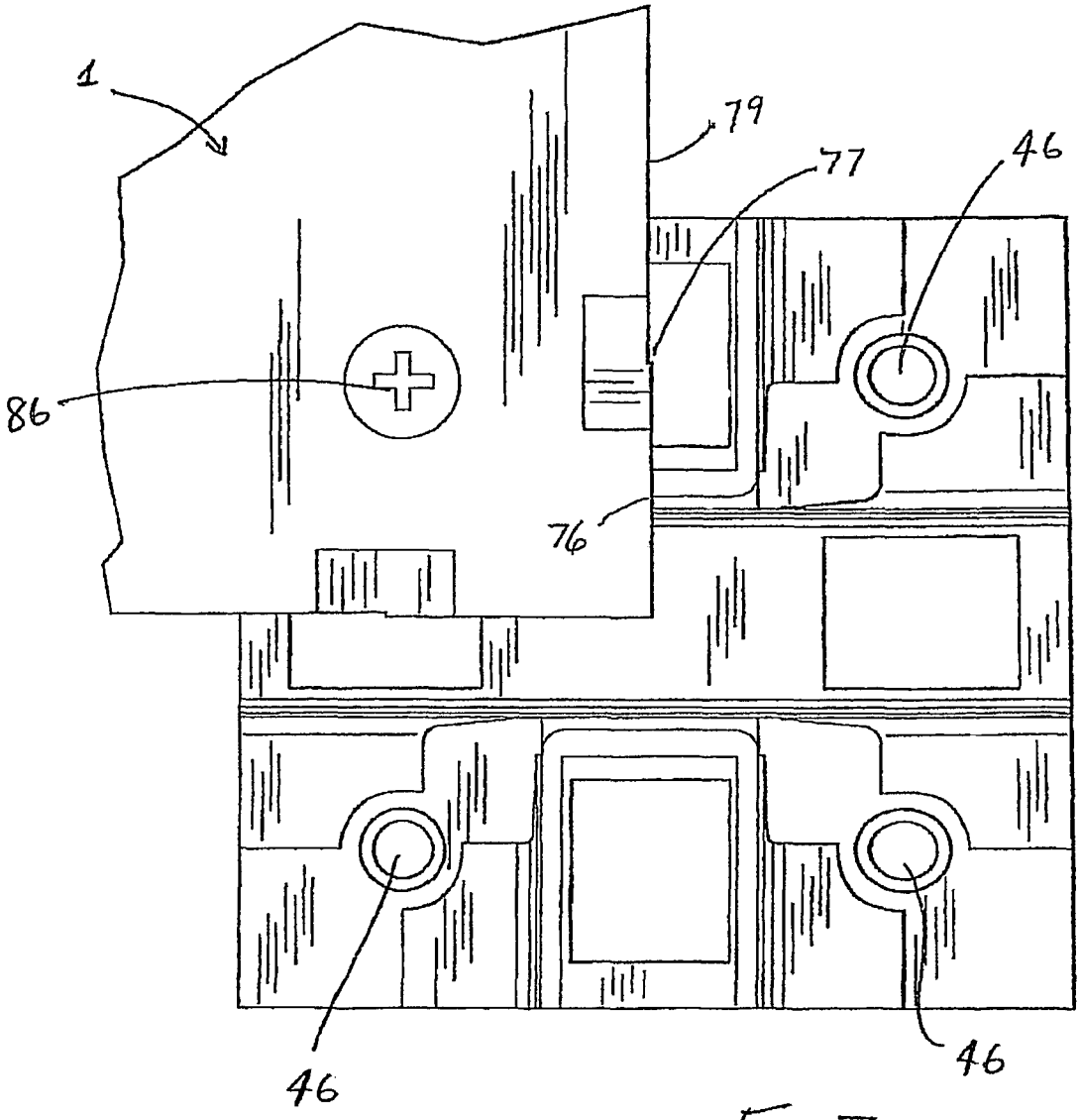
FIG. 7 is a top plan view of FIG. 6.
Figure 8:
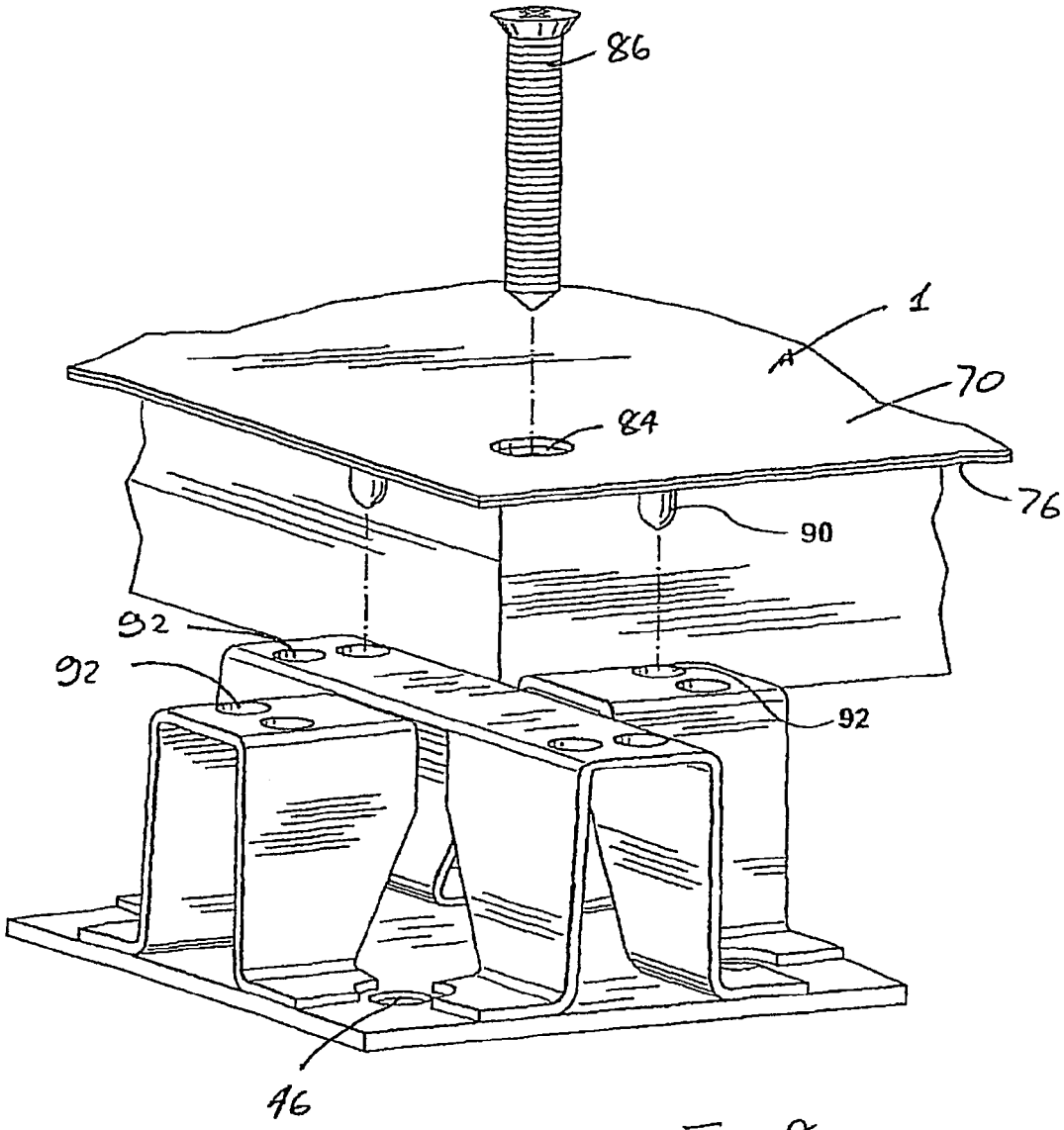
FIG. 8 is a perspective view of an alternative pedestal head of the invention.
Figure 9:
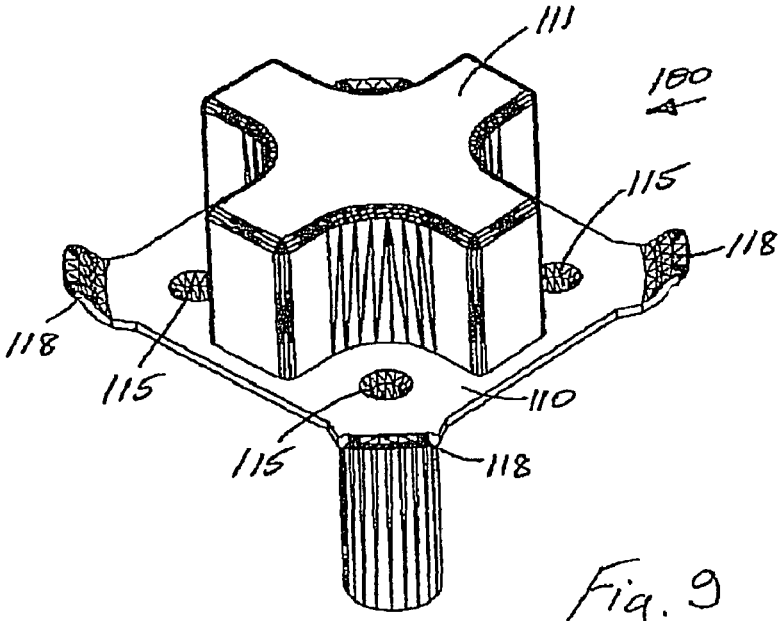
FIG. 9 is a perspective view of another pedestal head according to the invention.
Figure 10:
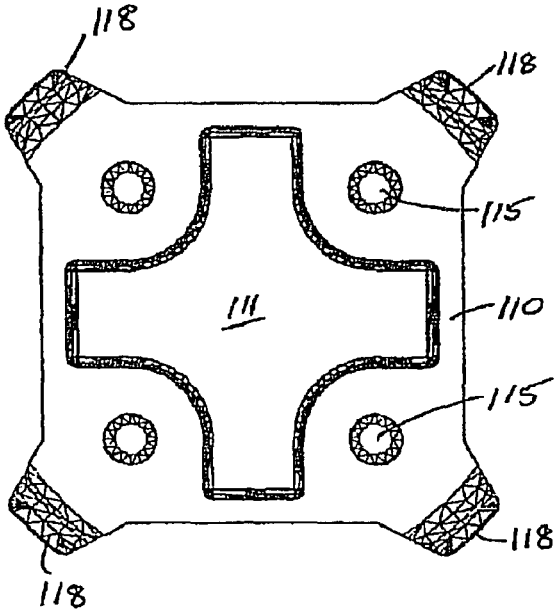
FIG. 10 is a side elevational view of the pedestal head of FIG. 9.
Figure 11:
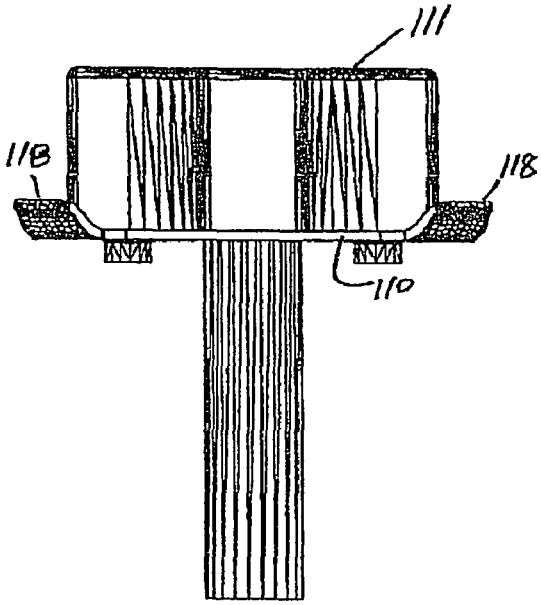
FIG. 11 is a plan view of the pedestal head of FIG. 9.
Figure 12:
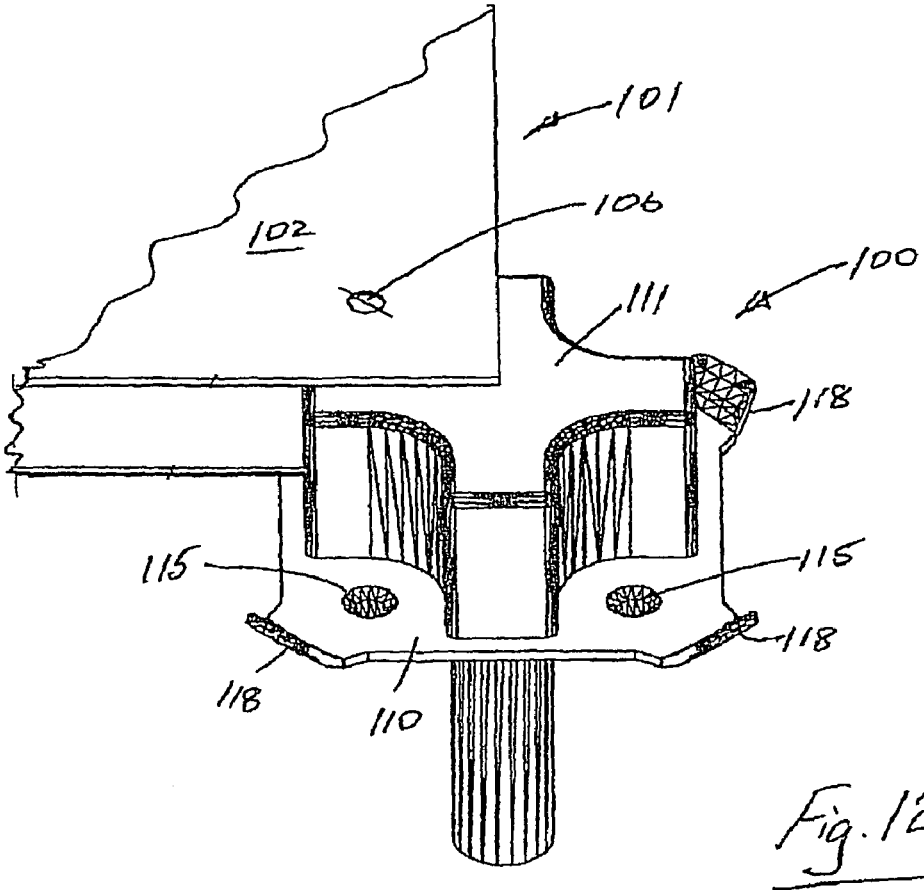
FIG. 12 is a perspective view of the pedestal head of FIGS. 9 to 11 with a panel in position.
Figure 13:
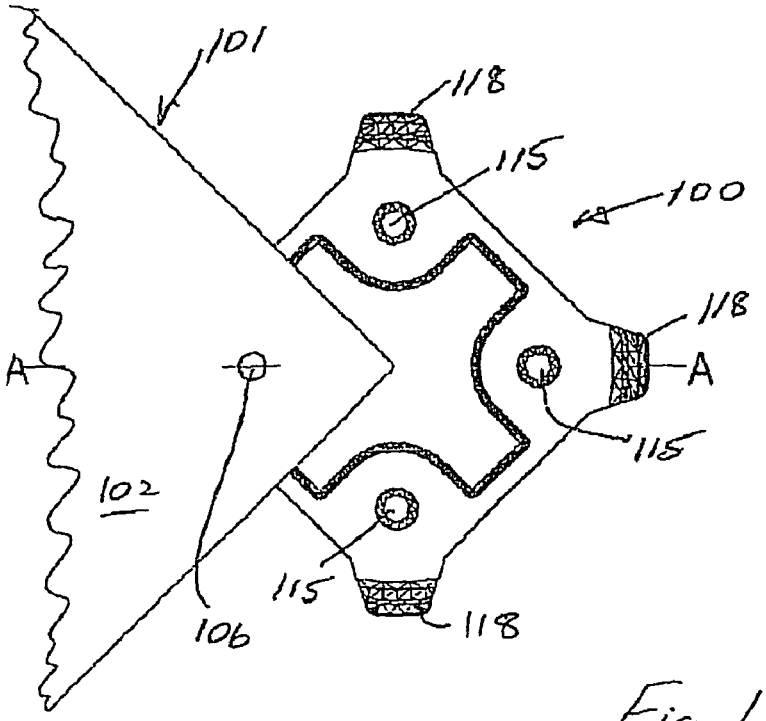
FIG. 13 is a top plan view of the pedestal head and panel of FIG. 12.

Any variety of projection 80 may be utilized including the tabs previously described or cones 90 as shown in FIG. 8. When utilizing cones it is possible to include at least two apertures 92 in each of the quadrants of the upper surface as shown in FIG. 7.

FIG. 8 illustrates the location of one corner of the panel 70 over the pedestal head locator.

It will be apparent that the invention described herein can be utilized so as to quickly clamp the access floor. In other words once the panel 70 is dropped into place it is located readily by the tabs or cones 90 in the appropriate apertures 42 or 92 in a manner whereby the bolt 86 may easily line up with the holes or threaded holes. In order to assist the application of the bolt 86 into the threaded hole 46 a countersink is formed.

Once the panel 70 is in place it is located by the tabs or projections which mechanically engage into the apertures of the pedestal head locator. Gravity now holds the panel 70 in place and the tabs 80 and cones 90 prevent the panels from sliding or moving off the pedestal head. Accordingly the panel 76 may be installed without bolts 86 and still have lateral stability.

Furthermore the load of the panel 70 is transferred through the top flange 78 to the centre of the pedestal, namely the central axis 99 of the pedestal 20 and inhibits the load from being cantilevered causing the prior art teeter-totter effect.

Moreover once the fastener 86 is in place the panel 70 is then clamped between the top portion of the pedestal, namely the upper surface 40, and the bottom portion 38. In other words the underside of the flange 78 rests on the upper surface 40 while the lower surface 74 rests on the base 38. Furthermore the corner of the bottom surface 74 is adapted to lie on the base 38 outwardly and away from the threaded hole 46 and the legs 36. The clamping effect described allows the panel 70 to be both top flange supported and bottom panel supported making this system superior to those prior art devices that are only top flange supported.

The panel 70 may be square, triangular or rectangular and made of steel, cement-filled steel, hollow steel, wood-filled steel, plastics, composites or the like. Furthermore the panel 70 may be a standard welded hollow steel and cement-filled.

The pedestal head locator may be made of steel, aluminium, composites or plastics. The upper surface of the pedestal head locator is located in each corner of the panel.

As is shown the invention adds a downwardly disposed projection on the underside of a perimeter lip that locates and locks into the pedestal head locator.

The invention describes a method of locating and fastening an access floor panel to a pedestal comprising: disposing a corner of the panel having a hole there through and a peripheral flange with projections depending therefrom, over a pedestal head having a base with a threaded hole and an upper surface extending from said base with an aperture for receiving and locating the projection; and inserting a fastener through said hole and threaded hole for fastening thereto.

FIG. 7 shows that the peripheral edge 76 of the panel has a setback between the peripheral edge 76 near the corner and peripheral edge 79 intermediate the corner. The edges 76 of adjacent panels abut while the intermediate edges 79 present a space between adjacent intermediate edge to make it easier to assemble and line up the adjacent panels. The setback 77 in one embodiment is in the vicinity of a few thousands of an inch. In one embodiment it can be about 5 thousands of an inch, however other dimensions are also suitable.

Referring to FIGS. 9 to 14 there is illustrated another pedestal head 100 according to the invention. The pedestal head is in this case used for panels 101 of the type having a top 102 with a peripheral flange 103 and a bottom 104 having a recess 105 which forms a receiver. The pedestal head 100 is in this case die formed/stretched out from a single piece of metal. The head comprises a base 110 and an upper support 111 which presents a generally flat face for receiving a corner portion of the peripheral flange 103 of a panel 101. The upper support 111 is of generally cruciform shape in plan view and can accommodate a peripheral flange corner portion of four panels.

The panel adjacent to the corner portion has a through hole 106 to accept a fastener 120 which in this case is a threaded bolt. The base 110 of the pedestal head has a threaded countersunk hole 115 adjacent each corner through which the fastener 120, is threaded. The base 110 also has a projection in the form of an upturned lip or tab 118 at each corner. A recess 105 in the bottom 104 of the panel 101 is received and located by the upturned lip 118. The lip 118 assists in preventing lateral movement between the panel 101 and the pedestal head 100.

Figure 14:
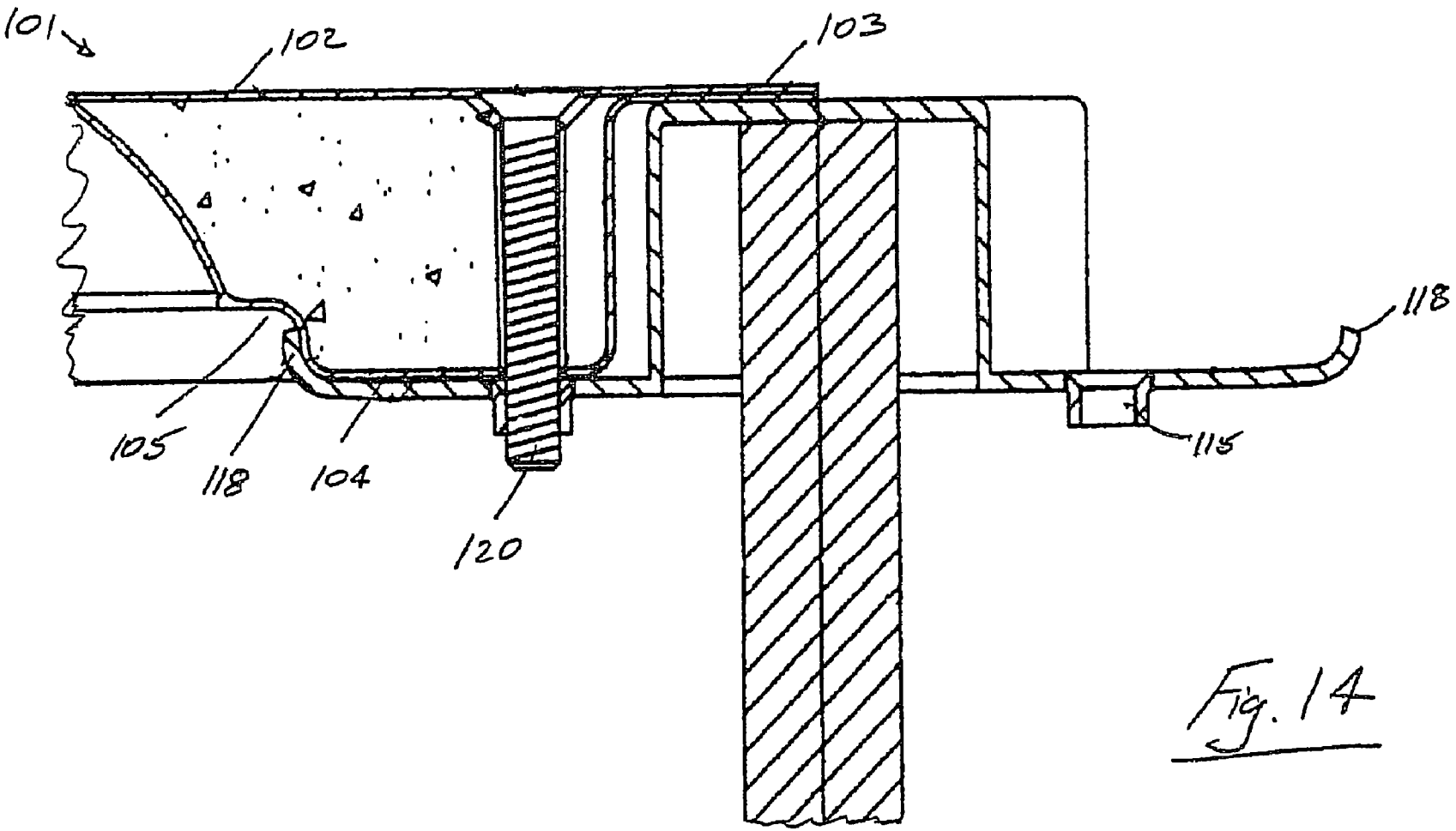
FIG. 14 is a cross sectional view on the line A-A of FIG. 13.

Referring especially to FIG. 14 the height h of the supporting head i.e. the distance between the top of the base 110 and the face of the upper support 111 is slightly greater (typically by less than 50 thousands of an inch) than the depth $h^1$ of the panel 101 i.e. the distance between the outer face of the bottom 104 of the panel and the underside of the flange 103. The panel 101 is set on top of the pedestal and the top peripheral flange 103 of the panel rests on the upper support 111 of the pedestal head 100 while the upturned tab 118 on the base of the head locates the panel 101 with respect to the fastening hole 115. The tab 118 prevents the panel 101 from moving off the pedestal head 100. The weight of the panel 101 (gravity) is sufficient to prevent significant lateral movement because of the upward projection of the tab 118 that mechanically locks into the bottom corner of the panel. The fact that the load is supported by the outer flange or lip 103 of the panel 101 allows load to be transferred to the centre of the pedestal stud or axis of the pedestal. This prevents the load from being cantilevered out by the bottom of the panel. Thus the teeter-totter effect caused by a less stable floor with consequent panel movement under moving loads and associated noises such as squeaks or creaks is thereby avoided.

The final application of the threaded fastener 120 connects the panel 101 to the pedestal. There is a small clearance between the bottom of the panel 101 and the bottom plate 110 of the pedestal to ensure the panel lip or flange 103 engages, and takes the first loads. Once the panel fastener 120 is torqued down the panel 101 is fastened to the pedestal using a clamping action which squeezes the panel 101 and pedestal head 100 together. The pedestal is clamped at right angles to the panel 101 which is desirable. Once four panels and a pedestal are connected with the fasteners it makes a rigid connection from panel to panel.

The other advantage to this system is that the locating tab 118 allows for the panels to be laid without the fasteners and the fasteners may be installed later, from the top while standing on the panels, with no concern of the panels slipping off the pedestal head. It also means that there is a safety factor if some fasteners 120 are removed for maintenance and people are walking on the floor, the panels 101 are still located and laterally stable because of the tabs 118 locking onto the bottom of the panels 101.

The speed of installation of this system will be 15% to 20% faster, which will significantly reduce the cost of labour.

In the invention, the panel 101 makes contact on the top cross portion support 111 of the pedestal head 100 and when a fastener 120 is fastened into the base 110 of the head 100 the entire connection becomes extremely rigid and it is not possible to flex at the joint. This rigidity is ensured by the single piece die formed pedestal head 100.

Various embodiments of the invention have now been described in detail. Since changes and/or additions to the above described best mode may be made without departing from the nature, spirit or scope of the invention, the invention is not to be limited to such details.

The invention claimed is:

1. A method of locating and fastening an access floor panel to a pedestal, the access floor panel having a bottom and a top with a peripheral flange extending therefrom, the floor panel having a hole therethrough adjacent to a corner thereof, a pedestal head having a base with a threaded hole extending therethrough and an upper support, the floor panel having a receiver formed in the base thereof for engagement with a projection on the base of the pedestal head, the method comprising the steps of:

disposing the corner of said floor panel over the pedestal head so that the flange is resting on the upper support of the pedestal head and the bottom of the floor panel is spaced slightly above the base of the pedestal head;

locating the floor panel relative to the pedestal head so that the receiver is aligned with the projection;

inserting a fastener through the hole of the floor panel and said threaded hole of said base of said pedestal head; and tightening the fastener so that the base of the pedestal head comes into contact with the bottom of the floor panel and the projection on the base of the pedestal head extends into the receiver of the floor panel while the fastener separately extends through the hole of the floor panel and said threaded hole of said base.

2. An access flooring system comprising:

a pedestal head; and a plurality of floor panels to be supported by the pedestal head, each of the floor panels including a floor panel top having a hole for receipt of a bolt or a screw; and a floor panel base, the floor panel base having a projection, said projection including a cone depending from a peripheral corner of said floor panel, the pedestal head including a pedestal base portion; and a pedestal upper support portion extending from the pedestal base portion, a threaded hole for receipt of the bolt or the screw extending through the hole of the floor panel top, the pedestal upper support portion having a receiver, the pedestal upper support portion having a support surface, the receiver of the pedestal upper support portion being engagable with the projection of the floor panel base seperated from the threaded hole and an underside of a peripheral flange of the floor panel top being supported on the support surface of the pedestal support portion on mounting of the floor panel on the pedestal head.

3. The access flooring system as claimed in claim 2, wherein the pedestal head is formed from a single piece of metal.

4. The access flooring system as claimed in claim 3, wherein the pedestal head is stretch formed.

5. The access flooring system as claimed in claim 3, wherein the pedestal head is die formed.

6. The access flooring system as claimed in claim 2, wherein a length of the pedestal head between the pedestal base and the upper support portion is slightly greater than a depth of said floor panel.

7. The access flooring system as claimed in claim 6, wherein a difference between the length of the pedestal head and the depth of the floor panel is less than about 50 thousands of an inch.

8. The access flooring system as claimed in claim 2, wherein said peripheral flange extends to substantially a central longitudinal axis of the pedestal head.

9. The access flooring system as claimed in claim 2, wherein said pedestal base portion includes a threaded hole, and said floor panel includes a hole alignable with said threaded hole for coaxially receiving a fastener.

10. The access flooring system as claimed in claim 2, wherein said pedestal base portion supports a bottom of said floor panel.

11. The access flooring system as claimed in claim 2, wherein said pedestal head is disposed at an upper end of a pedestal resting on a surface.

12. The access flooring system as claimed in claim 11, wherein said pedestal includes means for adjusting a height of said pedestal head relative to said surface.

* * * * *